US012127689B2

(12) United States Patent
Fischer et al.

(10) Patent No.: US 12,127,689 B2
(45) Date of Patent: Oct. 29, 2024

(54) SUPPORT COMPONENT, ARMREST WITH SUCH A SUPPORT COMPONENT AND CHAIR WITH SUCH AN ARMREST

(71) Applicant: VITRA AG, Birsfelden (CH)

(72) Inventors: Maik Fischer, Weil am Rhein (DE); Thomas Schneider, Schwörstadt (DE)

(73) Assignee: VITRA AG, Birsfelden (CH)

( * ) Notice: Subject to any disclaimer, the term of this patent is extended or adjusted under 35 U.S.C. 154(b) by 26 days.

(21) Appl. No.: 18/005,922

(22) PCT Filed: Jul. 30, 2021

(86) PCT No.: PCT/EP2021/071456
§ 371 (c)(1),
(2) Date: Jan. 18, 2023

(87) PCT Pub. No.: WO2022/023552
PCT Pub. Date: Feb. 3, 2022

(65) Prior Publication Data

US 2023/0270256 A1 Aug. 31, 2023

(30) Foreign Application Priority Data

Jul. 31, 2020 (CH) ..... 00964/20

(51) Int. Cl.
*A47C 7/54* (2006.01)

(52) U.S. Cl.
CPC ..... *A47C 7/541* (2018.08)

(58) Field of Classification Search
CPC ..... A47C 7/282; A47C 7/541
USPC ..... 297/452.56, 452.63, 452.64, 411.56, 297/411.63, 411.64
See application file for complete search history.

(56) References Cited

U.S. PATENT DOCUMENTS 3,117,819 A * 1/1964 Kudriavetz, Jr. ..... A47C 7/282 297/452.56 X
3,601,176 A * 8/1971 Savickas ..... A47C 7/22 403/53
4,602,819 A * 7/1986 Morel ..... B60N 2/667 297/452.56
4,761,035 A * 8/1988 Urai ..... A47C 7/40 297/452.56
5,536,070 A * 7/1996 Lemmen ..... A47C 7/541 297/411.36

(Continued)

FOREIGN PATENT DOCUMENTS

EP 1059051 A1 12/2000
GB 205151 10/1928

OTHER PUBLICATIONS

International Search Report and Written Opinion issued Nov. 11, 2021 in International Appl. No. PCT/EP2021/071456.

(Continued)

*Primary Examiner* — Rodney B White
(74) *Attorney, Agent, or Firm* — MEDLER FERRO WOODHOUSE & MILLS PLLC

(57) ABSTRACT

A support component for a chair is disclosed that includes a rigid base element, a support structure and a flexible cover. The support structure is mounted on the base element such that there is a space between the base element and the support structure when the support structure is without load. The cover is mounted directly on the support structure so that the cover rests on the support structure.

20 Claims, 4 Drawing Sheets

(56) References Cited

U.S. PATENT DOCUMENTS 6,213,557 B1 * 4/2001 Aebischer ..... B60N 2/686 297/452.56 X
6,231,125 B1 * 5/2001 Maeda ..... B60N 2/7011 297/452.56
6,343,839 B1 2/2002 Simons, Jr. et al.
6,361,117 B1 * 3/2002 Tate ..... B60N 2/70 297/452.56
6,786,544 B1 * 9/2004 Muraishi ..... B60N 2/36 297/452.56
6,948,775 B2 9/2005 Tsai
7,376,991 B2 * 5/2008 Stewart ..... A61G 13/0018 297/452.56
7,416,256 B2 * 8/2008 Fujita ..... B60N 2/548 297/452.56
7,503,627 B2 * 3/2009 Kawasaki ..... A47C 7/029 297/452.56
7,618,096 B2 * 11/2009 Fujita ..... B60N 2/7094 297/452.56
7,647,714 B2 * 1/2010 Coffield ..... B29C 45/14065 297/452.56 X
7,731,294 B2 * 6/2010 Yasuda ..... B60N 2/7058 297/452.56
8,029,060 B2 * 10/2011 Parker ..... A47C 7/004 297/300.1
8,087,727 B2 * 1/2012 Parker ..... A47C 7/445 297/316
8,096,615 B2 * 1/2012 Parker ..... A47C 1/03 297/284.3
8,506,016 B2 * 8/2013 Mizobata ..... B60N 2/686 297/452.56
8,590,978 B2 * 11/2013 Jaranson ..... B60N 2/646 297/452.56
8,613,481 B2 * 12/2013 Parker ..... A47C 7/445 297/411.36 X
8,622,472 B2 * 1/2014 Rajaratnam ..... A47C 7/282 297/452.56
8,668,265 B2 * 3/2014 Parker ..... A47C 1/036 297/300.1
8,678,505 B2 * 3/2014 Kanda ..... B60N 2/7011 297/452.56
8,888,183 B2 * 11/2014 Parker ..... A47C 7/14 297/316
8,960,699 B2 * 2/2015 Sprigle ..... A61G 5/1091 297/452.56
8,998,338 B2 * 4/2015 Vander Veen ..... A47C 7/462 297/452.56 X
9,326,613 B2 * 5/2016 Cvek ..... A47C 7/02
10,729,252 B1 * 8/2020 Chu ..... A47C 7/541
10,932,575 B2 * 3/2021 Masunaga ..... A47C 1/0307
11,019,928 B2 * 6/2021 Takagi ..... A47C 1/0307
11,229,294 B2 * 1/2022 Battey ..... A47C 7/462
11,357,329 B2 * 6/2022 Deevers ..... A47C 3/021
11,439,239 B2 * 9/2022 Masunaga ..... A47C 7/40
11,478,085 B2 * 10/2022 Sollie ..... F16B 7/1454
11,510,496 B1 * 11/2022 Zhang ..... A47C 1/0308
11,786,039 B2 * 10/2023 Deevers ..... A47C 7/029 297/452.56 X
11,805,913 B2 * 11/2023 Deevers ..... A47C 7/40
2002/0117885 A1 * 8/2002 Barile, Jr. ..... A47C 7/282 297/452.52
2003/0178882 A1 * 9/2003 Schmitz ..... A47C 1/03255 297/411.36
2007/0102987 A1 * 5/2007 Chen ..... A47C 31/02 297/452.56
2007/0170759 A1 * 7/2007 Nolan ..... A47C 31/023 297/452.56
2008/0079307 A1 * 4/2008 Su ..... A47C 7/282 297/452.56
2008/0106136 A1 * 5/2008 Heidmann ..... A47C 7/32 297/452.56
2010/0293772 A1 11/2010 Pan
2012/0086251 A1 4/2012 Parker et al.
2014/0183924 A1 * 7/2014 Cvek ..... A47C 7/282 297/452.21
2021/0120958 A1 * 4/2021 Chen ..... A47C 7/541
2022/0031075 A1 * 2/2022 Rajaratnam ..... A47C 7/40

OTHER PUBLICATIONS

International Search Report issued Apr. 28, 2021 in Swiss Patent Appl. No. CH 9642020.

* cited by examiner

SUPPORT COMPONENT, ARMREST WITH SUCH A SUPPORT COMPONENT AND CHAIR WITH SUCH AN ARMREST

TECHNICAL FIELD

The invention relates to a support component and more particularly to support components having a solid base element and a flexible cover that can be used as arm supports in armrests of chairs and as a seat or backrest in chairs.

BACKGROUND

Chairs and in particular office chairs usually have a seat and a backrest. When using such a chair, a user sits down in such a way that the buttocks are arranged on the seat and the back rests against the backrest or faces the backrest. The seat thus forms a support component for the buttocks and the backrest forms a support component for the back. Such chairs are often additionally equipped with armrests on which the user's forearms are placed. In particular, armrests usually have a quasi-horizontal support or a quasi-horizontal cushion on which the forearms can be placed. The pads or cushions thus form support components for the user's arms.

For example, EP 1 059 051 A1 describes an office chair that comprises two height-adjustable armrests. The armrests each have an upright rest pillar and an arm support attached thereto. The arm support consists of a base or floor plate mounted on the rest pillar and a padded plate.

For reasons of comfort, support components of chairs of the type described above are typically at least partially soft, flexible or resilient. In particular, it is known that such support components have a solid base element that has foam as padding which is surrounded by a textile or other protective cover that is pleasant to the touch.

Although such foams in support components can offer adequate comfort for a user, they are typically disadvantageous since they can cause problems in production and disposal, for example from an ecological point of view. In particular, foams usually have to be disposed of separately, which can be comparatively expensive. The foaming agents used in the production of foams are also often comparatively problematic. Furthermore, known foams often have properties that change over their service life, and therefore comfort can change.

The object of the present invention is therefore to propose a support component, an armrest and a chair which can be produced efficiently and in an environmentally friendly manner and which offer sufficient comfort over a comparatively long period of time. In addition, it is advantageous if the components can be separated according to type.

SUMMARY OF THE INVENTION

According to the invention, the object is achieved by a support component, an armrest and a chair as described herein. Advantageous embodiment variants of the invention are also described herein.

In one aspect, the invention is a support component for a chair. The support component comprises a rigid base element, a resilient support structure, and a flexible cover. The support structure is mounted on the base element such that there is a space between the base element and the support structure when the support structure is without load. The cover is mounted directly on the support structure, so that it rests on the support structure.

The support component can be a seat support or a seat, an arm support or an armrest component, or a back support or a backrest of a chair. The chair is in particular an office chair.

The term "without load" in connection with the support structure refers to a condition in which substantially no force acts on the support structure or on the bearing component. In particular, in the unloaded state, no force acts on the support structure that significantly deforms the support structure. Such a force can correspond to the gravity of a body part of a user when this is arranged as intended on the support component.

In the context of the invention, the term "flexible cover" refers to a cloth-like, film-like or textile-like structure which covers the support structure. In particular, it can cover the support structure in the direction of a user, so that a body part of the user is arranged on the support component by the body part contacting the cover or a portion thereof. The cover can be, but does not have to be, dimensionally stable. In particular, the cover is flexible in that it is significantly easier to deform than the support structure. The cover can be soft or flexible in comparison with the support structure, so that a body part can be placed thereon comfortably. The cover is advantageously made of a resilient material.

The support component according to the invention makes it possible to provide a practical and durable construction on which a body part of a user can be comfortably placed. The design according to the invention makes it possible to dispense with a foam, which allows improved disposal and production of the support component. In particular, it is easy to ensure that the components of the support component are separated according to type.

Preferably, the support structure is arranged so as to deform elastically into the space when loaded from the cover. In this way, resilient absorption of the gravity of the body part involved can be achieved, which can increase comfort.

In this case, the base element is preferably formed so that it substantially retains its shape when the support structure is elastically deformed into the space. The base element may be rigid in such a way that it substantially retains its inherent shape when the support structure is deformed into the space. As a result, the base element can give its shape to the entire support component. Typically, the base element is more rigid than the support structure, which in turn is more rigid than the cover.

The base element, the support structure and the cover are preferably made of different plastics materials. For example, the base element can be made of a solid thermoplastic material such as a polyamide or a fiber-reinforced polyamide. Polyamides and in particular fiber-reinforced polyamides typically have a comparatively high strength and toughness, which can be advantageous and desirable in the base element.

The support structure can be made, for example, from a polypropylene, a polyethylene or a similar thermoplastic material. Such plastics materials can have a comparatively high elasticity and resistance. In addition, they can be relatively light. In particular, the support structure is preferably made of an injection molded plastics material. Such injection molding of the support structure allows a comparatively large degree of design freedom when shaping the support structure. As a result, it can advantageously be adapted to its intended use.

The cover can be made of an elastomer, for example. A design of the support component with such materials allows efficient, robust and durable production and operation of the support component.

The base element is preferably trough-shaped. With such a trough-shaped base element, on the one hand, its strength can be efficiently ensured and, on the other hand, the space can be provided. The trough-shaped base element can be provided with struts in order to increase the dimensional stability or strength.

Preferably, the support structure comprises a covering provided with a plurality of openings. In particular, the covering can be hood-shaped or curved, but it can also be planar. The plurality of openings preferably forms at least one perforation. With such a covering and in particular such a perforated covering, the support structure can be efficiently adapted to the intended load. For example, the support structure can be made softer or more flexible by providing a relatively large number of openings and/or providing large openings. In addition, a covering can allow comparatively simple production and shaping of the support structure.

The plurality of openings preferably forms a plurality of ridges. Such ridges can form resilient elements that specify an elasticity of the support structure.

In a first preferred embodiment, the ridges extend substantially over the entire support structure.

In an alternative second preferred embodiment, the plurality of openings forms a central region and the ridges extend from the central region to a periphery or an edge of the support structure.

The ridges preferably extend radially or in the form of rays from the central region to the periphery. Such radial ridges allow a preferred spring action of the support structure. In addition, they also allow efficient, sufficiently stable support for the cover. The spring strength and the spring effect of the support structure can be flexibly adapted to the intended use of the support component via the design of the ridges.

The plurality of openings preferably forms a terminal edge or a terminal border as the periphery of the support structure. In this case, the terminal edge is preferably formed around the circumference. The ridges preferably connect the central region to the terminal edge. Such a terminal edge can give the support structure the required stability, especially if it is equipped with radial ridges. In this case, the peripheral terminal edge can simultaneously form a connecting portion of the support structure, as is explained in more detail below.

The support structure is preferably formed integrally or in one piece. In this way, a comparatively simple assembly of the support component can be achieved. In particular in comparison to other constructions in which several elements have to be assembled to form a construction similar to a support structure, such a design allows the support component to be produced efficiently. In this case, the above-mentioned injection molded production of the support structure can allow a one-piece design in a particularly efficient manner.

Preferably, the base element has a first connecting portion and the support structure has a corresponding second connecting portion, the connecting portions being designed such that the base element and the support structure rest flush against one another when the first connecting portion is connected to the second connecting portion. The second connecting portion can in particular be formed by the above-mentioned terminal edge, so that the terminal edge and the second connecting portion are identical. The first connecting portion can also be formed as an edge of the base element. In this case, this edge or the first connecting portion advantageously comprises a circumferential, for example groove-like holder, in which the terminal edge can be arranged.

The space preferably extends substantially continuously or without interruption between the base element and the support structure. Since the space extends over virtually the entirety of the base element in this way, the support structure can provide a comparatively high freedom of movement or flexibility.

In another aspect, the invention is an armrest for a chair, comprising a support component as described above. The support component can develop its effect particularly advantageously in an armrest. In particular, the advantages and effects explained above in connection with the support component according to the invention and its preferred design variants can be realized in an efficient manner with the armrest according to the invention.

Preferably, the armrest comprises a fixed arm part or support part on which the support component is movably mounted. Because the support component is attached in a movable and possibly also rotatable manner, it can be efficiently adapted to the needs of the user.

The base element of the support component is preferably provided with a longitudinal opening, the arm part has a pin element and the pin element of the arm part protrudes through the longitudinal opening of the base element of the support component. With such a construction, the movability can be achieved efficiently.

In yet another aspect, the invention is a chair comprising a support component as described above and in particular two armrests as described above. The support component can advantageously develop its effect in a chair. In particular, the advantages and effects explained above in connection with the support component according to the invention and its preferred design variants and the armrest according to the invention and its preferred design variants can be realized in an efficient manner.

BRIEF DESCRIPTION OF THE DRAWINGS

Further advantageous designs of the invention can be found in the following description of embodiments of the invention with reference to the schematic drawings. In particular, the support component according to the invention, the armrest according to the invention and the chair according to the invention are described in more detail below with reference to the accompanying drawings on the basis of embodiments.

DETAILED DESCRIPTION

Figure 1:
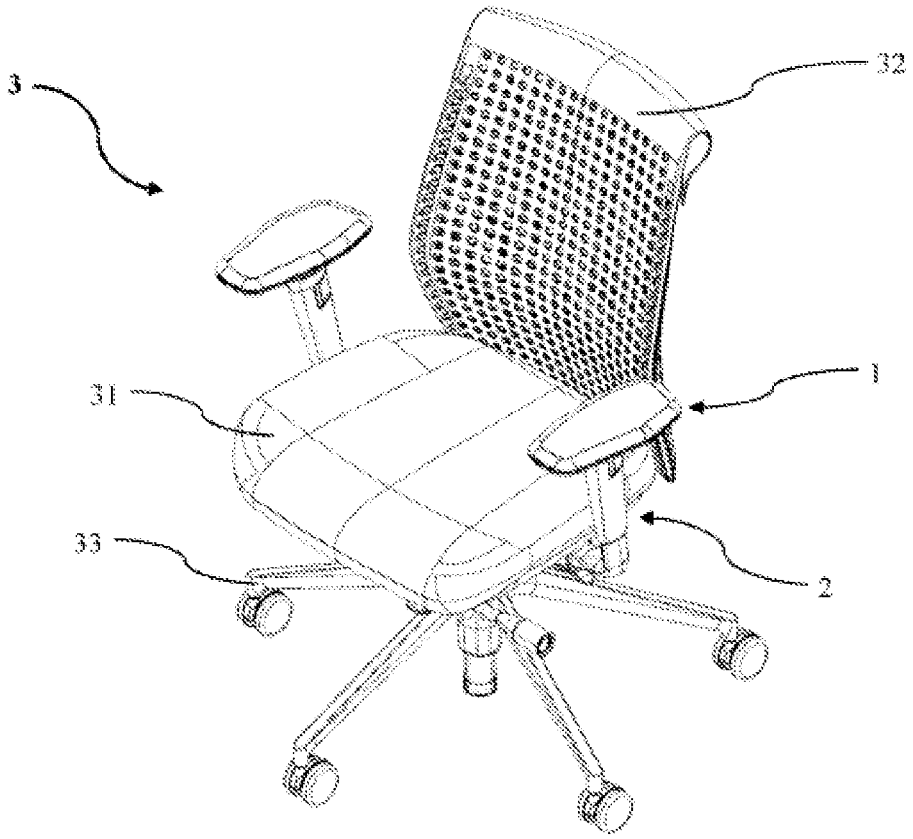
FIG. 1 is a perspective view of an embodiment of a chair according to the invention with an embodiment of armrests according to the invention, each comprising an embodiment of a support component according to the invention.

Certain terms are used in the following description for practical reasons and are not intended to be limiting. The words "right," "left," "below" and "above" indicate directions in the drawings to which reference is made. The terms "inward," "outward," "below," "above," "left," "right" or similar are used to describe the arrangement of designated parts relative to one another, the movement of designated parts relative to one another and the directions toward or away from the geometric center of the invention and designated parts thereof as shown in the drawings. This spatial relative information also comprises different positions and orientations from those shown in the drawings. For example, if a part shown in the drawings is reversed, elements or features that are described as "below" are then "above." The terminology comprises the words expressly mentioned above, derivatives thereof and words of similar meaning.

In order to avoid repetitions in the drawings and the associated description of the different aspects and embodiments, certain features are to be understood as common for different aspects and embodiments. The omission of an aspect in the description or a drawing does not suggest that this aspect is missing in the associated embodiment. Rather, such omission can serve for clarity and avoiding repetitions. In this context, the following specification applies to the entire further description: If reference signs are included in a drawing for the sake of clarity of the drawing, but are not mentioned in the directly associated description text, reference is made to the explanation thereof in the preceding descriptions of the drawings. If reference signs which are not contained in the associated drawing are also mentioned in the description text that belongs directly to a drawing, reference is made to the preceding and following drawings. Similar reference signs in two or more drawings represent similar or identical elements.

FIG. 1 shows an embodiment of a chair 3 according to the invention, which has two armrests 2 according to the invention, which are each equipped with an embodiment of a support part 1 according to the invention. The chair 3 comprises a base 33 with castors on which a seat 31 is mounted so as to be rotatable and height-adjustable. A backrest 32 is arranged on a rear side of the seat 31 and the two armrests 2 on the side of the seat 31.

Figure 2:
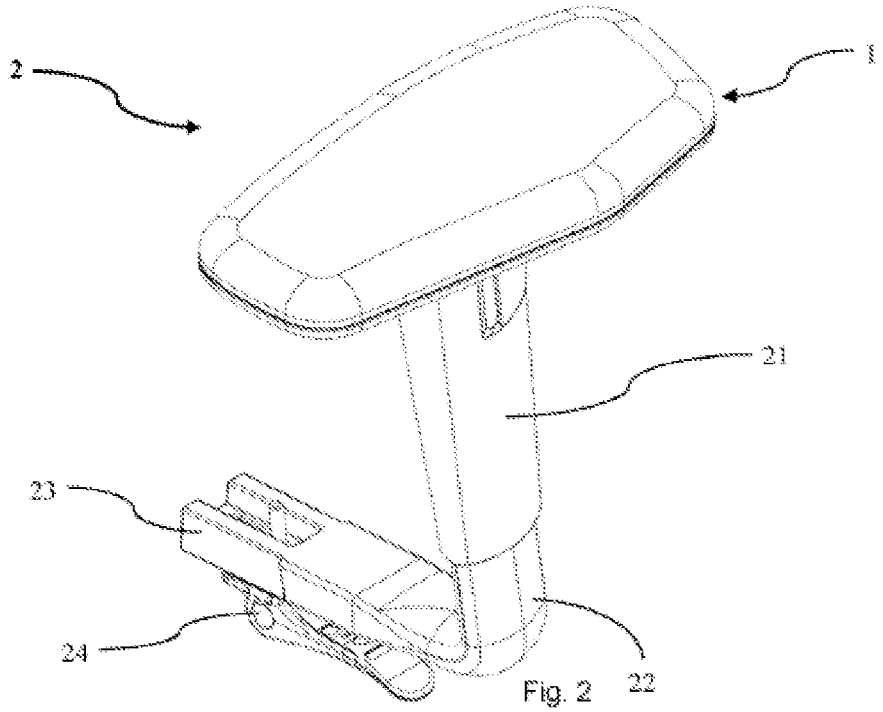
FIG. 2 is a perspective view of one of the armrests of FIG. 1.

In FIG. 2, one of the two armrests 2 is shown. The armrest 2 comprises an arm part or support part which has an L-shaped bar 22 and a cover 21. A quasi-vertical portion of the bar 22 extends from below into the cover 21. The cover 21 can be variably connected to the bar 22 at different heights, so that the arm part is height-adjustable.

The support component 1 is mounted on the sleeve 21 and extends virtually horizontally. An end of a virtually horizontal portion of the bar 22 facing the seat 31 is equipped with a fork portion 23 which forms a slot that is open on the left side. A pin of a clamping part 24 extends through the slot. The arm part can be connected to the seat 31 at a variable distance therefrom by means of the clamping part 24.

Figure 3:
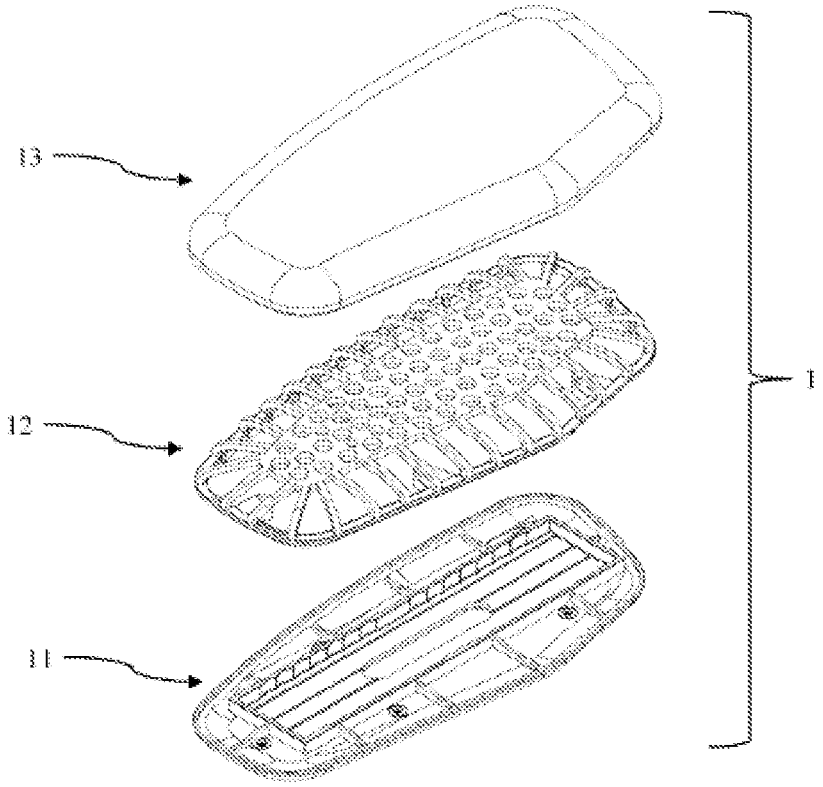
FIG. 3 is an exploded perspective view of one of the support components of FIG. 1.

FIG. 3 shows the structure of the support component 1. In particular, the support component 1 consists of three components: a base element 11, a support structure 12 and a cover 13. The base element 11 is made in one piece from a fiber-reinforced polyamide. The support structure 12 is made in one piece from a polypropylene. The cover 13 is made in one piece from an elastomer.

Figure 4:
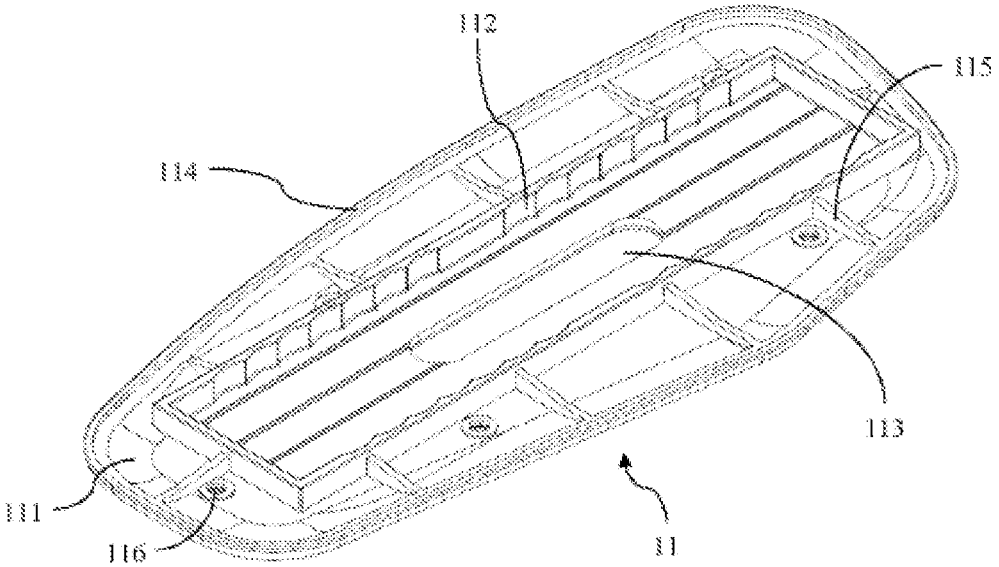
FIG. 4 is a perspective view of a base element of the support component of FIG. 3.

As can be seen in FIG. 4, the base element 11 comprises a trough 111 which is defined by a peripheral edge 114. The trough 111 is virtually shaped like the sole of a shoe when viewed from above. It is equipped with a large number of struts 115 which give the base element 11 a relatively high level of strength and stability. The trough 111 is also provided with a plurality of screw holes 116. The edge 114 forms a holder shaped to receive the support structure 12.

The base element 11 has a slot 113 as a longitudinal opening, which slot extends centrally in the base element 11 over approximately a third of a length of the base element 11. Along the slot 113 and beyond, two parallel straight struts 115 are equipped with a displacement detent 112.

In the assembled state shown in FIG. 2, a pin element of the cover 21 of the arm part projects through the slot 113. A head of the pin element is engaged with the displacement detent 112 of the base element 11 in such a way that the support component 1 can be moved in a detented or stepwise manner along the slot 113 relative to the cover 21.

Figure 5:
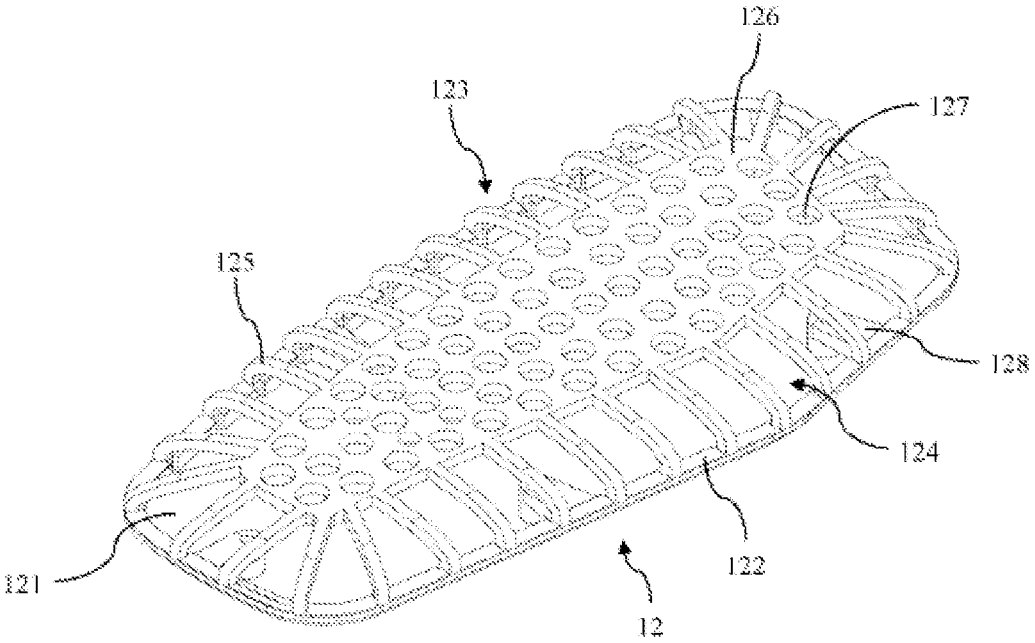
FIG. 5 is a perspective view of a first variant of a support structure of the support component of FIG. 3.

FIG. 5 shows a first possible variant of a support structure 12 for the support component 1 in a situation without load. The support structure 12 comprises a peripheral and continuous terminal edge 122 from which a hood-shaped covering 123 extends which forms a periphery of the support structure. Below the covering 123 there is a continuous space 121. The covering 123 is provided with a plurality of openings 124 forming the shape of the covering 123. In particular, the openings 124 are designed such that the covering 123 is shaped as follows:

The covering 123 comprises a central region 126 and thirty-two ridges 125 spaced more or less regularly from one another. The ridges 125 connect the terminal edge 122 to the central region 126. In particular, the ridges 125 protrude upward at a right angle from the terminal edge 122 and extend over a bend virtually horizontally until they merge radially or in the form of rays into the central region 126. The central region 126 is connected to the closing edge 122 around the periphery via the ridges 125. The central region 126 is virtually planar and comprises a large number of perforations 127.

Properties such as elasticity and support stability of the support structure 12 can be specified via the configuration of the ridges 125 and the perforations 127. For example, the number and thickness of the ridges 125 can determine how easily the support structure 12 can be elastically deformed into its space 121.

For assembly on the base element 11, the peripheral terminal edge 122 is designed to correspond to the edge 114 of the base element 11, so that the support structure 12 and the base element 11 can rest flush against one another. In particular, the terminal edge 122 of the support structure 12 can be accommodated by the holder of the edge 114 of the base element 11. The edge 114 of the base element 11 thus forms a first connecting portion and the terminal edge 122 of the support structure 12 forms a second connecting portion. In addition, the terminal edge 122 is provided with a plurality of screw receptacles 128 which are arranged to match the screw openings 116 of the base element 11. In particular, screws can engage through the screw openings 116 into the screw receptacles 128, so that the base element 11 and the support structure 12 are firmly connected to one another.

Figure 6:
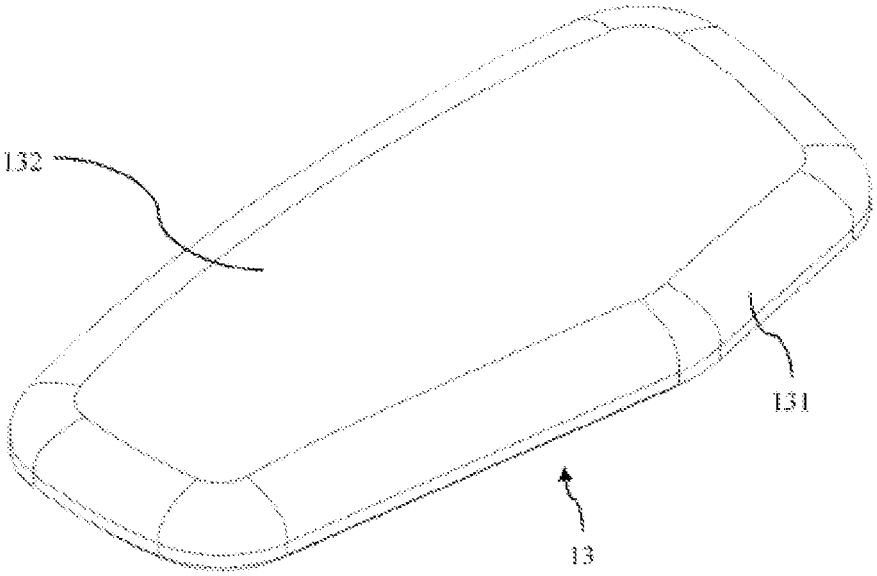
FIG. 6 is a perspective view of a cover of the support component of FIG. 3.

FIG. 6 shows the cover 13 of the support component 1. It has a flat support surface 132 and a peripheral edge 131. In particular, the cover 132 is designed to conform to the shape of the support structure 12, although it is slightly undersized. In addition, it is made of a resilient material. The cover 13 can thus be mounted on the support construction 12 by being pulled or stretched over the support construction 12. At the same time, the edge 131 of the sleeve 13 also, at its lower end, encompasses the edge 114 of the base element 11.

Figure 7:
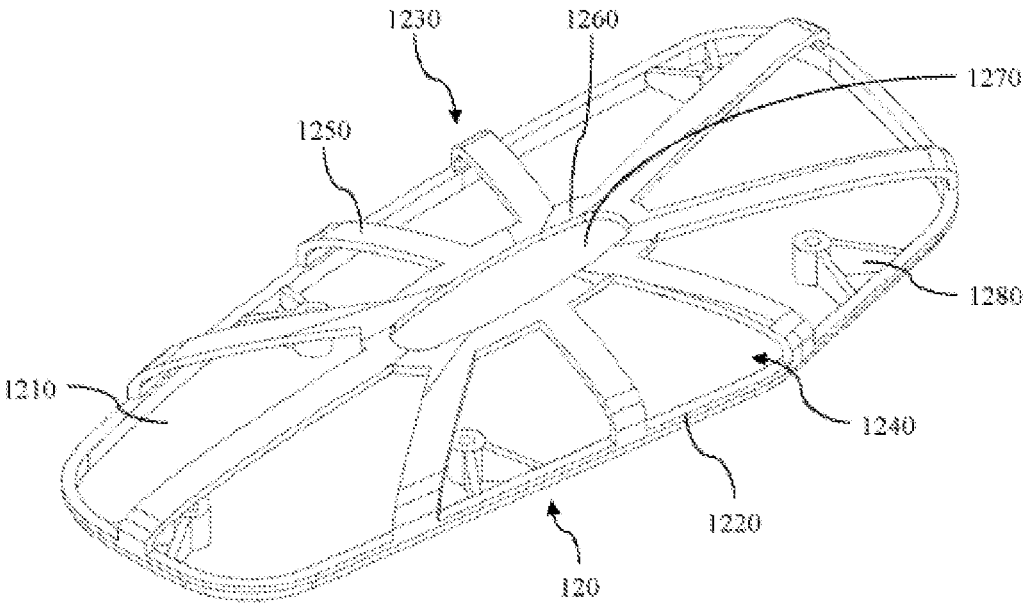
FIG. 7 is a perspective view of a second variant of the support structure of the support component of FIG. 3.

FIG. 7 shows a second variant of a possible support construction 120 in a situation without load, which construction can be installed in the support component 1 as an alternative to the support construction 12 of FIG. 5. The support construction 120 comprises a continuous terminal edge 1220 with screw receptacles 1280 and a covering 1230 with openings 1240. The openings 1240 form nine ridges 1250 and a central region 1260 in the covering 1230. The central region 126 is oval and is provided with a central opening 1270 which is also oval. The ridges 1250 radially connect the terminal edge 1220 to the central region 1260.

Due to the changed design of the number and shape of the ridges 1250 and the central region 1260, the properties of the support structure 120 are different from those of the support structure 12 of FIG. 5. In this way, the support component 1 can be adapted and optimized to the given requirements.

Although the invention is illustrated and described in detail by means of the drawings and the associated description, this illustration and this detailed description are to be understood as illustrative and exemplary and not as limiting the invention. In order not to transfigure the invention, in certain cases well-known structures and techniques cannot be shown and described in detail. It is understood that persons skilled in the art can make changes and modifications without departing from the scope of the following claims. In particular, the present invention covers further embodiments with any combination of features that may differ from the combinations of features explicitly described.

The present disclosure also includes embodiments with any combination of features mentioned or shown above or below for various embodiments. It also includes individual features in the drawings, even if they are shown there in connection with other features and/or are not mentioned above or below. The alternatives of embodiments and individual alternatives of the features thereof that are described in the drawings and the description can be excluded from the subject matter of the invention or from the disclosed subject matter. The disclosure includes embodiments that only comprise the features described in the claims or in the embodiments and also those that comprise additional different features.

Furthermore, the term "comprise" and derivatives thereof do not exclude other elements or steps. Likewise, the indefinite article "a" or "an" and derivatives thereof do not exclude a plurality. The functions of a plurality of features listed in the claims can be fulfilled by one unit or one step. The terms "substantially," "about," "approximately" and the like in connection with a property or a value in particular also define exactly the property or exactly the value. The terms "about" and "approximately" in connection with a given numerical value or range can refer to a value or range which lies within 20%, within 10%, within 5% or within 2% of the given value or range.

What is claimed is:

1. A support component for a chair comprising:

a rigid base element;

a flexible cover; and a resilient support structure, wherein the support structure is mounted on the base element such that there is a space between the base element and the support structure when the support structure is without load, and, wherein the cover is mounted directly on the support structure so that the cover rests on the support structure, and wherein the support structure is arranged so as to deform elastically into the space when loaded from the cover.

2. The support component according to claim 1, wherein the base element is formed so that it substantially retains its shape when the support structure is elastically deformed into the space.

3. The support component according to claim 1, wherein the base element, the support structure and the cover are each made of different plastics materials.

4. The support component according to claim 1, wherein the base element comprises a rigid thermoplastic material.

5. The support component according to claim 1, wherein the base element is trough-shaped.

6. The support component according to claim 1, wherein the support structure is made of an injection molded plastics material.

7. The support component according to claim 1, wherein the support structure comprises a covering provided with a plurality of openings.

8. The support component according to claim 7, wherein the plurality of openings forms at least one perforation.

9. The support component according to claim 7, wherein the plurality of openings forms a plurality of ridges.

10. The support component according to claim 9, wherein the ridges extend substantially over the entire support structure, or wherein the plurality of openings forms a central region and the ridges extend from the central region to a periphery of the support structure.

11. The support component according to claim 10, wherein the ridges extend radially from the central region to the periphery.

12. The support component according to claim 10, wherein the plurality of openings forms a terminal edge at the periphery of the support structure, and wherein the terminal edge is formed around the periphery.

13. The support component according to claim 12, wherein the ridges connect the central region to the terminal edge.

14. The support component according to claim 1, wherein the support structure is formed in one piece.

15. The support component according to claim 1, wherein the base element has a first connecting portion and the support structure has a corresponding second connecting portion, wherein the first and second connecting portions are configured such that the base element and the support structure rest flush against one another when the first connecting portion is connected to the second connecting portion.

16. The support component according to claim 1, wherein the space extends substantially continuously between the base element and the support structure.

17. An armrest for a chair, comprising a support component according to claim 1.

18. The armrest according to claim 17, comprising a rigid arm part on which the support component is movably mounted.

19. The armrest according to claim 18, wherein the base element of the support component is provided with a longitudinal opening, the arm part has a pin element and the pin element of the arm part protrudes through the longitudinal opening of the base element of the support component.

20. A chair comprising two armrests each comprising a support element according to claim 1.

* * * * *